US005802657A

United States Patent [19]

Nogues et al.

[11] Patent Number: 5,802,657

[45] Date of Patent: Sep. 8, 1998

[54] CLEANING DEVICE FOR BROOMS

[76] Inventors: Juana M. Nogues; Nelson E. Nogues, both of 3115 NW. 96th St., Miami, Fla. 33147

[21] Appl. No.: 759,248

[22] Filed: Dec. 2, 1996

[51] Int. Cl.[6] ..... A47L 25/00

[52] U.S. Cl. ..... 15/142; 15/246

[58] Field of Search ..... 15/38, 104.53, 15/142, 246

[56] References Cited

U.S. PATENT DOCUMENTS 3,170,182 2/1965 Burian ..... 15/142

3,172,139 3/1965 Wire ..... 15/246

*Primary Examiner*—Terrence Till

*Attorney, Agent, or Firm*—J. Sanchelima

[57] ABSTRACT

A cleaning device for cleaning brooms that include a plurality of bristles mounted at the end of the broom's handle. The cleaning device includes a handle member that has a C-shape embracing member for removably mounting the cleaning device to the broom's handle. One end of the handle member includes a rake assembly with a plurality of rigid teeth mounted thereon. The teeth are sufficiently long to pass through the bristles and permit, when moved downwardly through them, removal of extraneous material entangled on the bristles.

3 Claims, 2 Drawing Sheets

CLEANING DEVICE FOR BROOMS

BACKGROUND OF THE INVENTION

1. Field of the Invention.

The present invention relates to a device for cleaning a broom, and more particularly, to the type that is removably mounted to the handle of the broom.

2. Description of the Related Art.

The typical broom's bristle collects extraneous materials that become entangled in-between and require their eventual removal by a user, many times with his or her hands. There are no devices or utensils to accomplish this task known to applicant that can be removably stored on the broom itself thereby ensuring its availability when needed. Also, with a cooperative design, the cleaning device does not affect the use of the broom.

SUMMARY OF THE INVENTION

It is one of the main objects of the present invention to provide a device that permits a user to clean the dust and other debris entangled in broom's bristle portion.

It is another object of this invention to provide a cleaning device that a user can conveniently store by removably attaching to the handle of a broom.

It is still another object of the present invention to provide a device that is volumetrically efficient and relatively light for storage without materially affecting the way a broom is used.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
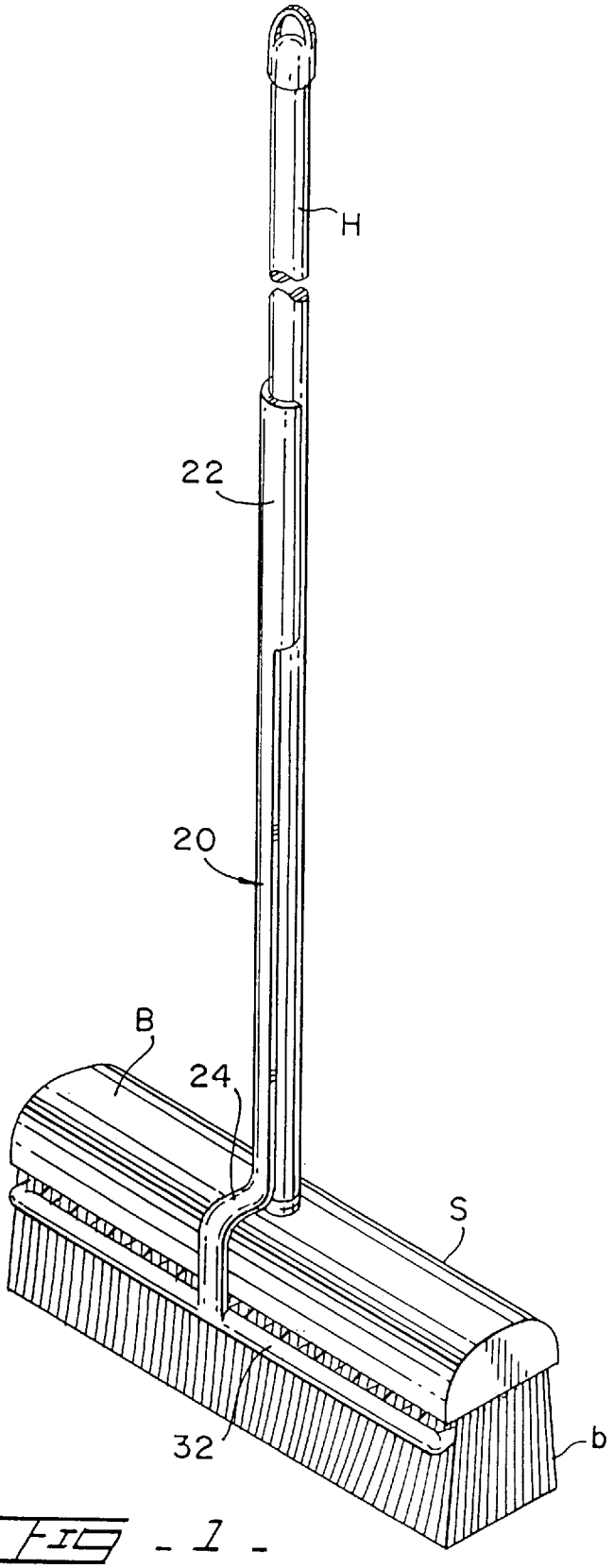
FIG. 1 is an isometric view of a the preferred embodiment of the present invention mounted to the handle of a conventional broom.

Referring now to the drawings, where the present invention is generally referred to with numeral 10, it can be observed that it basically includes elongated handle member 20 with C-shape embracing member 22 rigidly mounted at its uppermost end and rake assembly 30 rigidly mounted to its lowermost portion.

Figure 3:
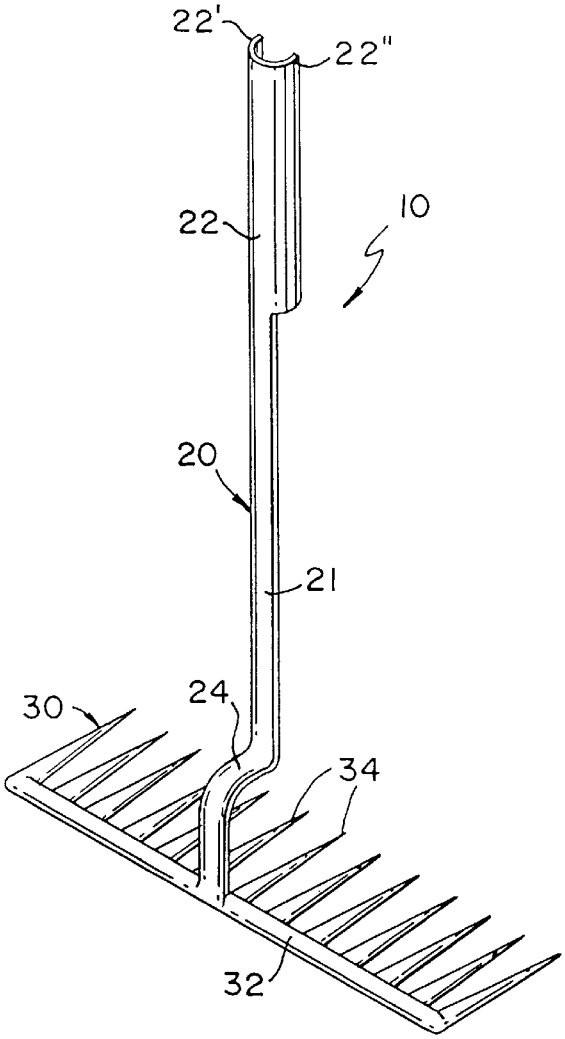
FIG. 3 is an isometric view of the invention.
Figure 2:
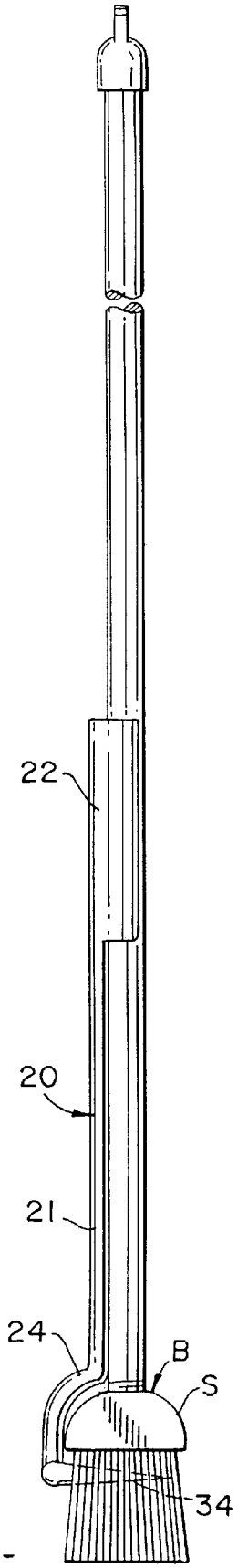
FIG. 2 is a side elevational view of the preferred embodiment mounted to a broom's handle.

As shown in FIGS. 1 through 3, cleaning device 10 is removably mounted to handle or broomstick H of broom B by C-shape embracing member 22 of elongated arm member 20. C-shape embracing member 22 is made out of a resilient material that permits a user to removably mount cleaning device 10 to handle H by applying a slight force to cammingly deflect sides 22' and 22". Sides 22' and 22" spring back towards each other keeping cleaning device 20 attached to handle H. Elongated arm member 20, in the preferred embodiment, has arcuated portion 24 located at the lowermost end of handle 21 and is designed to match different dimensions and configurations of shoulder or spine S of brooms B that holds bristles b.

Arcuated portion 24 has rake assembly 30 rigidly mounted at its distal end. Rake assembly 30 includes shoulder member 32 with several teeth 34 rigidly mounted thereto. Teeth 34 are preferably made of a hard firm material that permits this insertion through bristles b to remove dust and other debris materials collected while sweeping with broom B.

To use, a user removes cleaning device 10 from broom B by removing C-shape member 22 from handle H, and still keeping teeth 34 within bristles b. The user actuates C-shape 22 as a handle and slides down teeth 34 thereby removing the undesirable particles stored within bristles b of broom B.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cleaning device for brooms that include an elongated straight handle with two ends and a spine assembly perpendicularly mounted at one of said ends and said spine holding a plurality of bristles extending perpendicularly therefrom, and said cleaning device comprising:

A) an elongated handle having first and second end, said handle further includes a resilient C-shape embracing member with cooperative dimensions to removably mount to said elongated straight handle upon the application of a predetermined force that causes said C-shape embracing member to cammingly expand and, after clearing the diameter of said elongated straight handle firmly embracing said elongated straight handle thereby keeping said elongated handle in place; and B) a rake assembly mounted at said second end and said rake assembly including a plurality of rigid teeth of sufficient length and positioned to pass through said bristles.

2. The device set forth in claim 1 wherein said C-shape embracing member is positioned adjacent to said first end.

3. The device set forth in claim 2 wherein said second end includes an arcuate portion that cooperatively conforms to the shape of said spine thereby permitting said elongated handle means to be removably mounted adjacent to said handle means.

* * * * *